US009513056B2

(12) United States Patent
Schoenster

(10) Patent No.: US 9,513,056 B2
(45) Date of Patent: Dec. 6, 2016

(54) DRYER VENT STABILIZING APPARATUS

(71) Applicant: James Schoenster, East Hampton, NY (US)

(72) Inventor: James Schoenster, East Hampton, NY (US)

( * ) Notice: Subject to any disclaimer, the term of this patent is extended or adjusted under 35 U.S.C. 154(b) by 617 days.

(21) Appl. No.: 13/962,120

(22) Filed: Aug. 8, 2013

(65) Prior Publication Data

US 2014/0206277 A1 Jul. 24, 2014

Related U.S. Application Data

(63) Continuation-in-part of application No. 29/443,556, filed on Jan. 18, 2013, now Pat. No. Des. 690,065.

(51) Int. Cl.
*F26B 21/00* (2006.01)

(52) U.S. Cl.
CPC ..... *F26B 21/004* (2013.01)

(58) Field of Classification Search
CPC ..... F26B 21/004; F26B 11/02; D06F 58/20
USPC ..... 454/339; 34/138, 139, 140, 235
See application file for complete search history.

(56) References Cited

U.S. PATENT DOCUMENTS 2,825,148 A * 3/1958 Olson ..... D06F 58/22 261/112.1
3,677,517 A 7/1972 Root et al.
3,999,304 A 12/1976 Doty
4,137,647 A * 2/1979 Clark, Jr. ..... B01D 39/1676 138/89
D258,609 S 3/1981 Vogt
4,277,315 A 7/1981 Volkamer et al.
4,338,731 A 7/1982 Shames et al.
4,434,564 A * 3/1984 Braggins, Jr. ..... D06F 58/20 34/235
D277,131 S 1/1985 Shames et al.
4,969,276 A * 11/1990 Walsh ..... D06F 58/22 34/235
D314,820 S 2/1991 Sullivan
D411,901 S 7/1999 Gomulinski
D423,660 S 4/2000 Inda
6,230,418 B1 * 5/2001 Gomulinski ..... D06F 58/04 285/181
6,729,586 B2 5/2004 Arguijo et al.
6,745,491 B1 6/2004 Hernandez-Zelaya
6,997,966 B2 2/2006 Iantorno
D604,828 S 11/2009 Krohmer et al.
D635,239 S 3/2011 Liebson et al.
(Continued)

*Primary Examiner* — Steven B McAllister
*Assistant Examiner* — Reginald McNeill, II
(74) *Attorney, Agent, or Firm* — Dale J. Ream

(57) ABSTRACT

A dryer vent stabilizing apparatus for use with a dryer appliance having a vent tube includes a base member having opposed front and rear edges and an upper surface on which to secure the dryer appliance. A first support member is operatively coupled to the rear edge of the base member, the first support member having opposed first support member ends and defining a lateral channel extending substantially between respective first support member ends. A vent engagement member is slidably coupled to the lateral channel of the first support member and selectively movable along the lateral channel between the respective first support member ends, the vent engagement member defining an aperture configured to receive the vent tube of the dryer appliance therethrough.

17 Claims, 9 Drawing Sheets

(56) References Cited

U.S. PATENT DOCUMENTS

| | | | | |
|---|---|---|---|---|
| D658,831 | S | 5/2012 | Robinson et al. | |
| 9,173,321 | B2 * | 10/2015 | Yu | H05K 7/20145 |
| 2010/0031527 | A1 | 2/2010 | Robinson et al. | |
| 2014/0179215 | A1 * | 6/2014 | Yu | G07F 9/10 454/184 |

* cited by examiner

DRYER VENT STABILIZING APPARATUS

REFERENCE TO RELATED PATENT APPLICATIONS

The present application is a continuation in part of U.S. Design patent application 29/443,556, filed Jan. 18, 2013, and titled "Adjustable Dryer Vent Positioning Bracket," now pending.

BACKGROUND OF THE INVENTION

This invention relates generally to appliances and, more particularly, to a dryer vent stabilizing apparatus that enables the vent tube exiting a dryer appliance to be secured at a proper angle for efficient operation, to be protected from damage, and to be maintained in that configuration even if the dryer appliance is later repositioned slightly.

A flexible vent or exhaust duct, also referred to as a vent "tube," extends from the rear of a dryer appliance and is directed to an outlet port to the outside of a house. Unfortunately, the vent tube is often pinched against a wall at an inefficient or sometimes even dangerous angle and is difficult for a resident or technician to position as desired. For instance, the vent tube may exit the dryer at a lateral or vertical position that is not aligned with the exit port of the house—leading to the angling of the tube that may pinch airflow or be difficult to manipulate. Another problem is that even a vent duct that is at first properly positioned may become undesirably bent or pinched if the dryer appliance is later repositioned laterally by the homeowner. Still another problem is that a flexible vent duct that becomes bent may allow for lint buildup that is dangerous.

Therefore, it would be desirable to have a dryer vent stabilizing apparatus that stabilizes the position of a vent duct extending from the rear of a dryer appliance. Further, it would be desirable to have a dryer vent stabilizing apparatus that is horizontally and vertically adjustable so as to universally receive a vent tube at its point of exit from the dryer. In addition, it would be desirable to have a dryer vent stabilizing apparatus that is easy to reposition and readjust. Still further, it would be desirable to have a stabilizing apparatus that provides a "hard duct" from the conventional dryer vent tube through the apparatus and to a point displaced from the dryer. Such an apparatus would reduce or eliminate the problems identified above and would provide for easy positioning of a dryer, stabilizing of the vent duct, reduction of lint, and elimination of pinched flex tubing.

SUMMARY OF THE INVENTION

Accordingly, a dryer vent stabilizing apparatus for use with a dryer appliance having a vent tube according to the present invention includes a base member having opposed front and rear edges and an upper surface on which to support the dryer appliance. A first support member is operatively coupled to the rear edge of the base member, the first support member having opposed first support member ends and defining a lateral channel extending substantially between respective first support member ends. A vent engagement member is slidably coupled to the lateral channel of the first support member and selectively movable along the lateral channel between the respective first support member ends, the vent engagement member defining an aperture configured to receive the vent tube of the dryer appliance therethrough in a "hard duct" arrangement.

The apparatus allows for a hard duct/tube to extend from the dryer through the apparatus and to a home's vent to the outside. It is impossible with the present invention for the vent duct to become pinched. A resident does not have difficulty accessing the back of the dryer in order to manipulate the vent tubing as the dryer may now be easily slid in and out of its position for cleaning and the duct never becomes pinched.

Therefore, a general object of this invention is to provide a dryer vent stabilizing apparatus for stabilizing and positioning a vent duct/tube that extends from the rear of a dryer appliance such that the vent tube is not positioned in an inefficient or dangerous configuration between the dryer appliance and a vent hole in a home's exterior wall.

Another object of this invention is to provide a dryer vent stabilizing apparatus, as aforesaid, that is laterally and vertically adjustable so as to receive the appliance vent tube at precisely the horizontal and vertical position at which it extends from the appliance.

Still another object of this invention is to provide a dryer vent stabilizing apparatus, as aforesaid, that secures the vent tube in a "hard duct" with a clamp so that the tube is not inadvertently reshaped or repositioned.

Yet another object of this invention is to provide a dryer vent stabilizing apparatus, as aforesaid, that may be situated, in part, under the dryer appliance and be used to easily reposition the dryer as desired.

A further object of this invention is to provide a dryer vent stabilizing apparatus, as aforesaid, that is easy to install, adjust, and use.

A still further object of this invention is to provide a dryer vent stabilizing apparatus, as aforesaid, that is economical to manufacture and sell.

Other objects and advantages of the present invention will become apparent from the following description taken in connection with the accompanying drawings, wherein is set forth by way of illustration and example, embodiments of this invention.

DESCRIPTION OF THE PREFERRED APPARATUS

Figure 1:
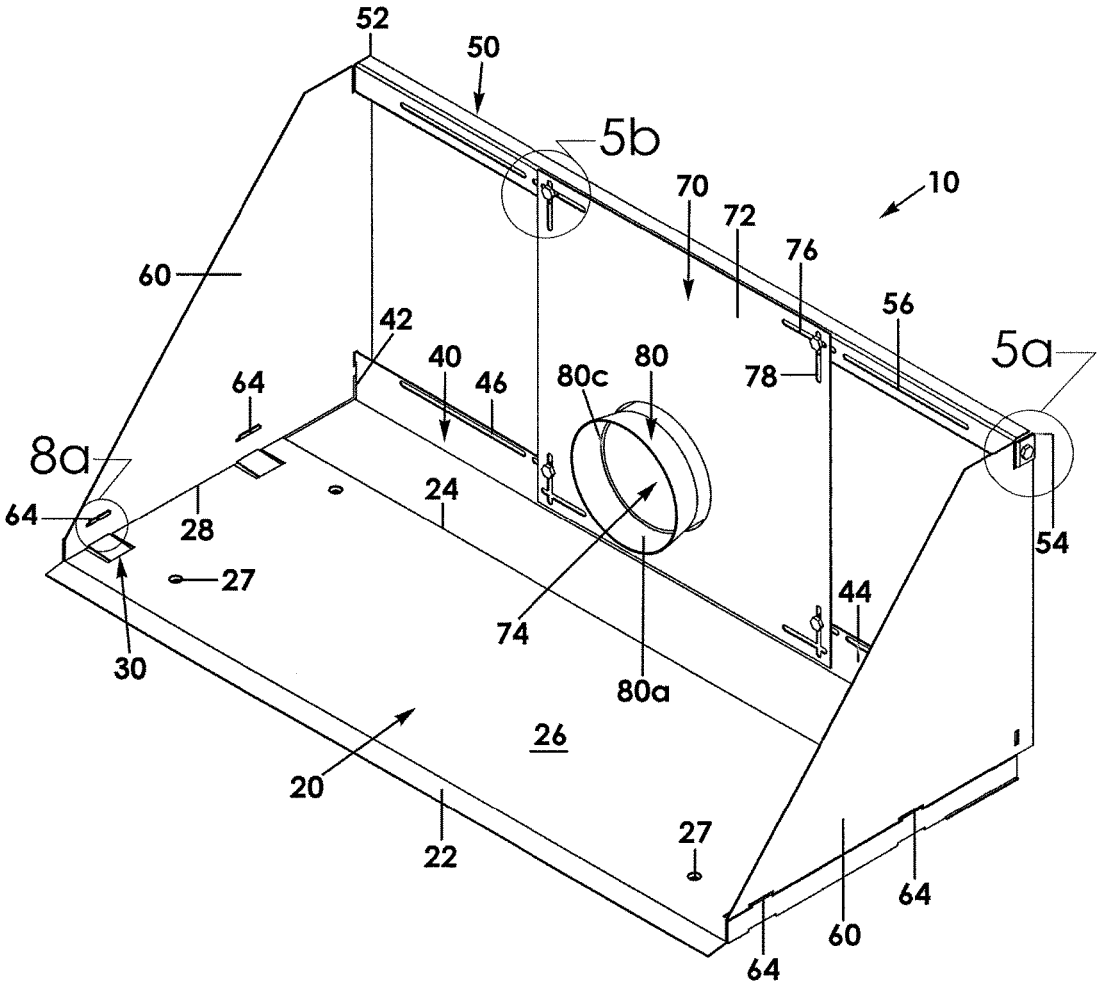
FIG. 1 is a perspective view of a dryer vent stabilizing apparatus according to a preferred embodiment of the present invention.
Figure 2:
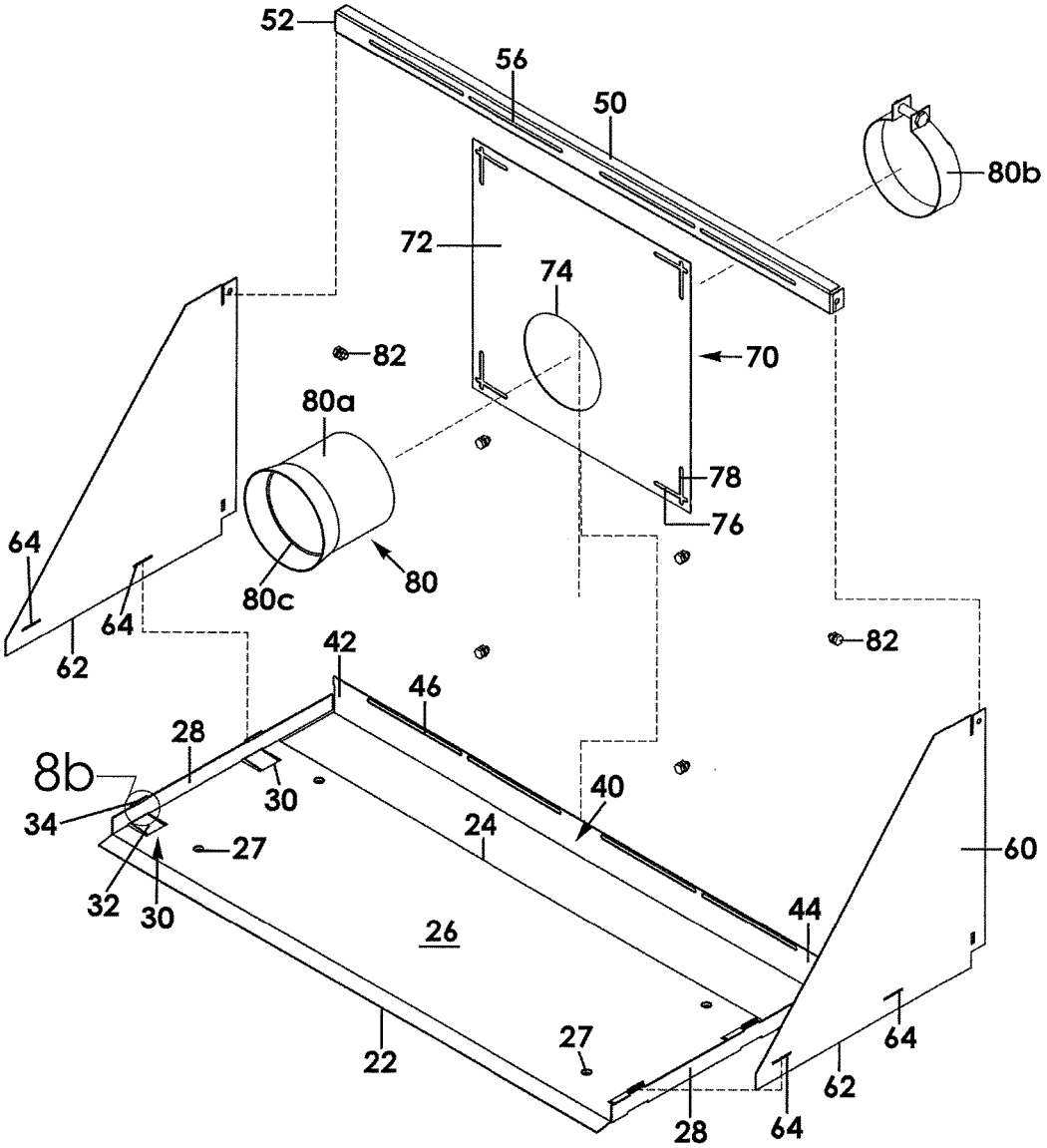
FIG. 2 is an exploded view of the apparatus as in FIG. 1.
Figure 3A:
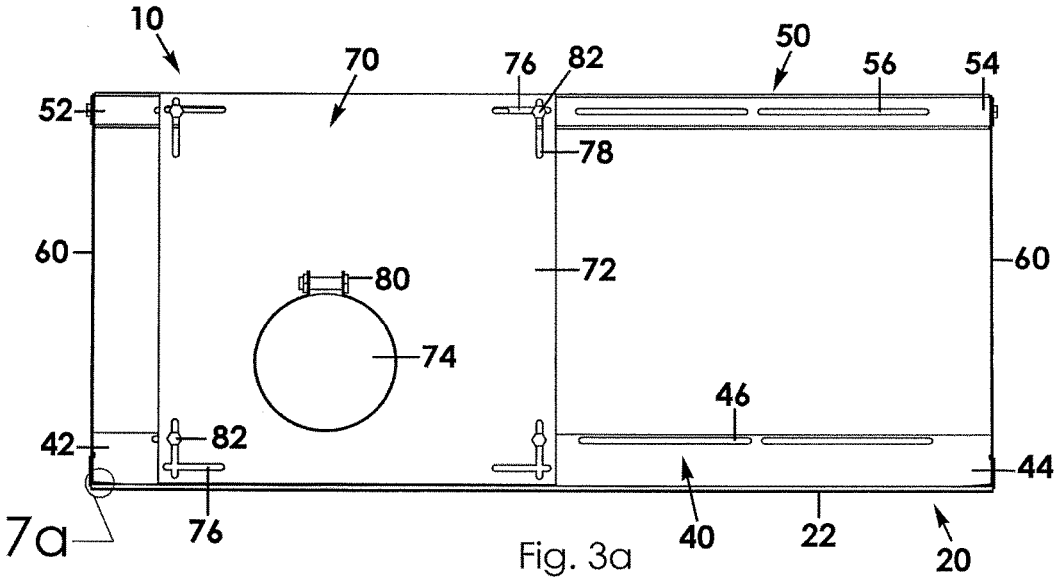
FIG. 3*a* is a front view of the apparatus as in FIG. 1 illustrating a vent engagement member at one lateral configuration.
Figure 3B:
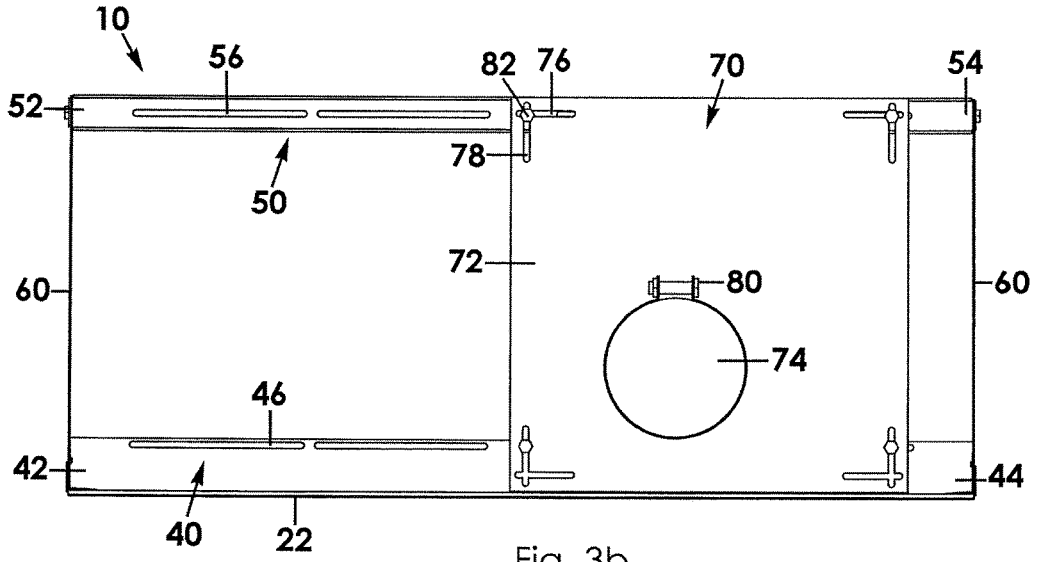
FIG. 3*b* is a front view of the apparatus as in FIG. 1 illustrating a vent engagement member at another lateral configuration.
Figure 4A:
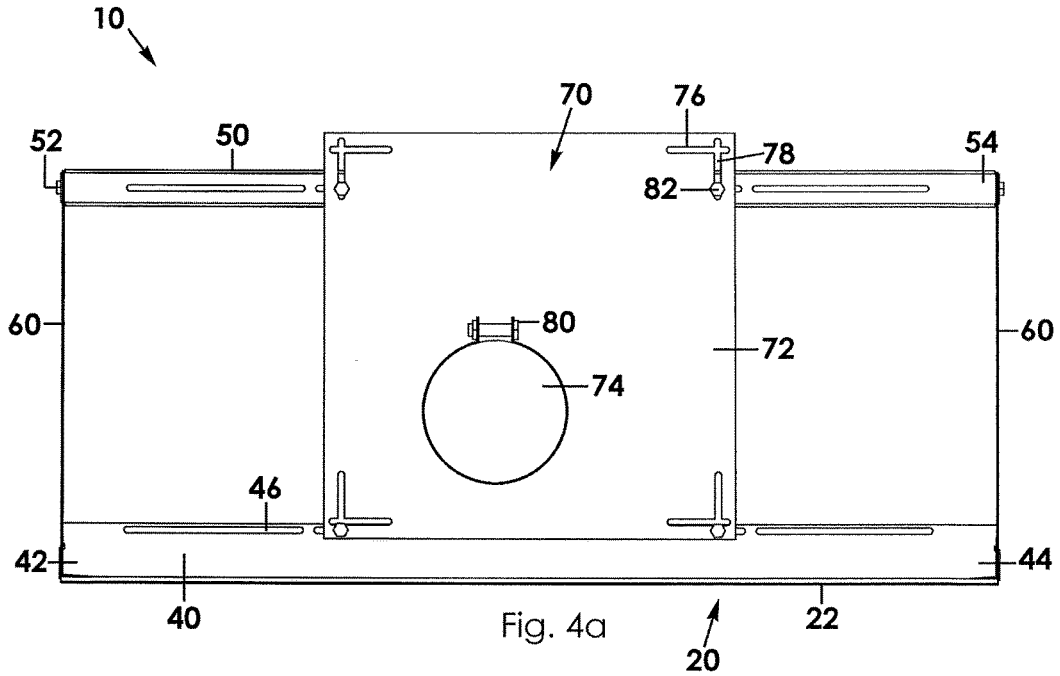
FIG. 4*a* is a front view of the apparatus as in FIG. 1 illustrating a vent engagement member at one vertical configuration.
Figure 4B:
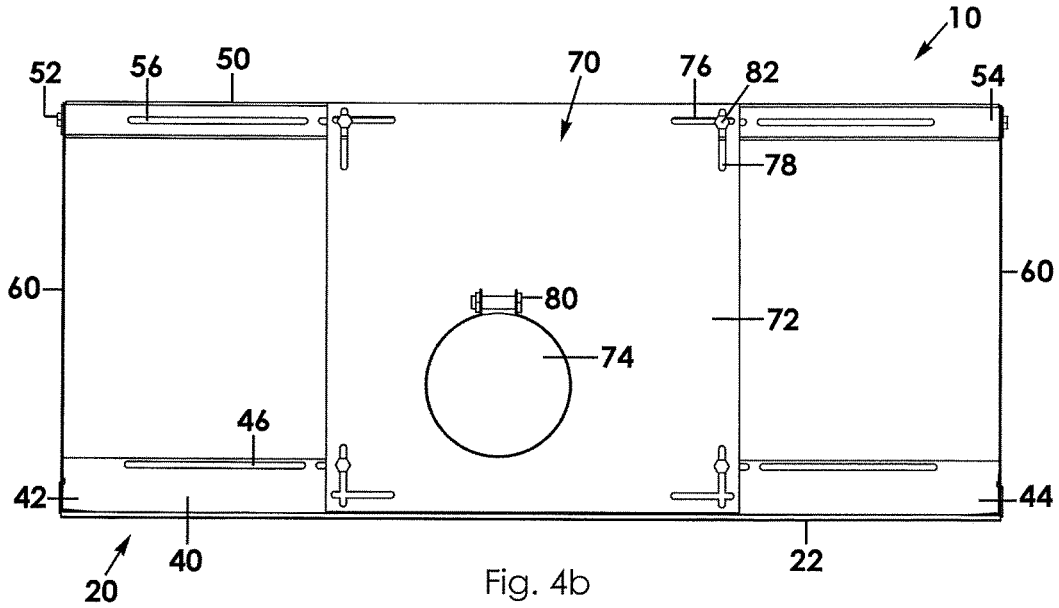
FIG. 4*b* is a front view of the apparatus as in FIG. 1 illustrating a vent engagement member at another vertical configuration.
Figure 5A:
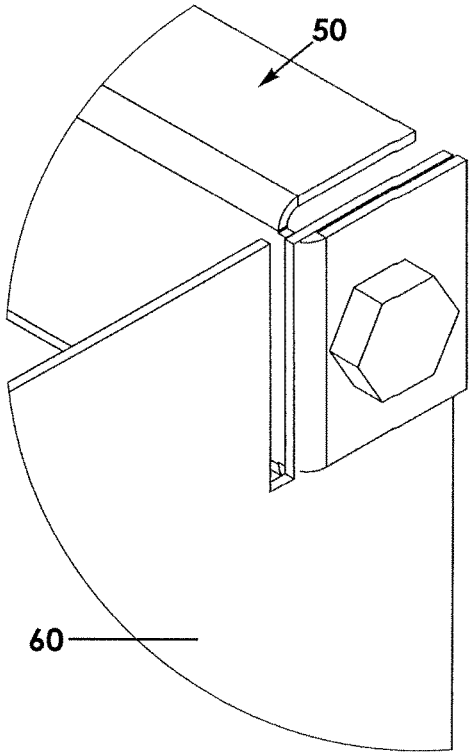
FIG. 5*a* is an isolated view on an enlarged scale taken from FIG. 1.
Figure 5B:
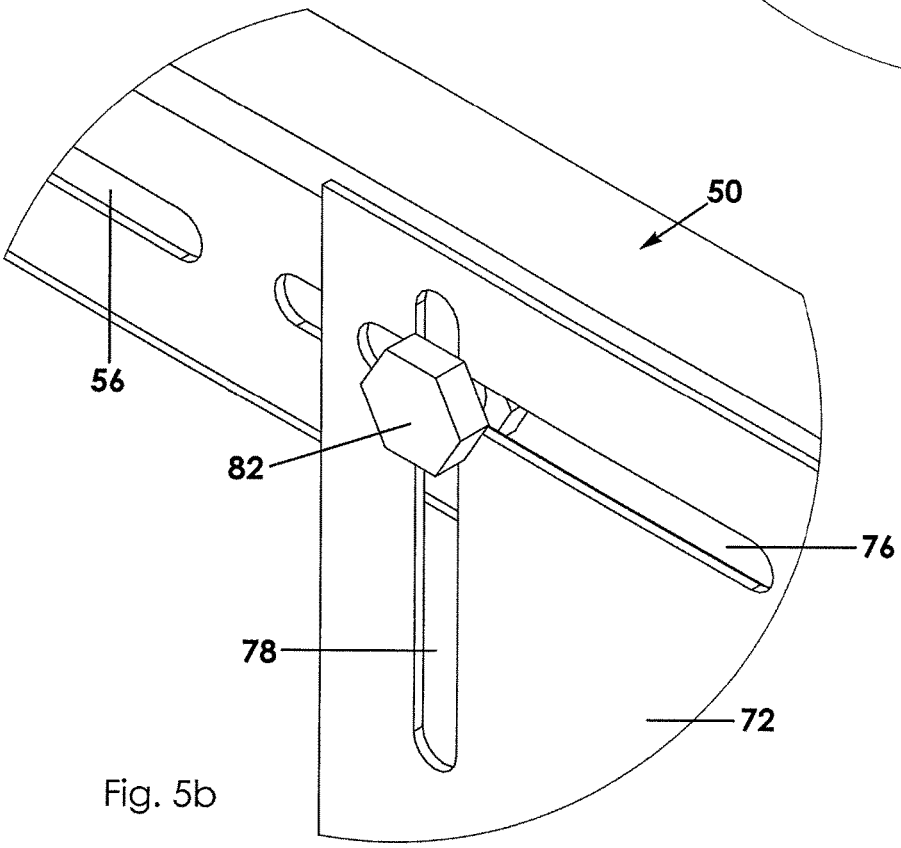
FIG. 5*b* is an isolated view on an enlarged scale taken from FIG. 1.
Figure 6:
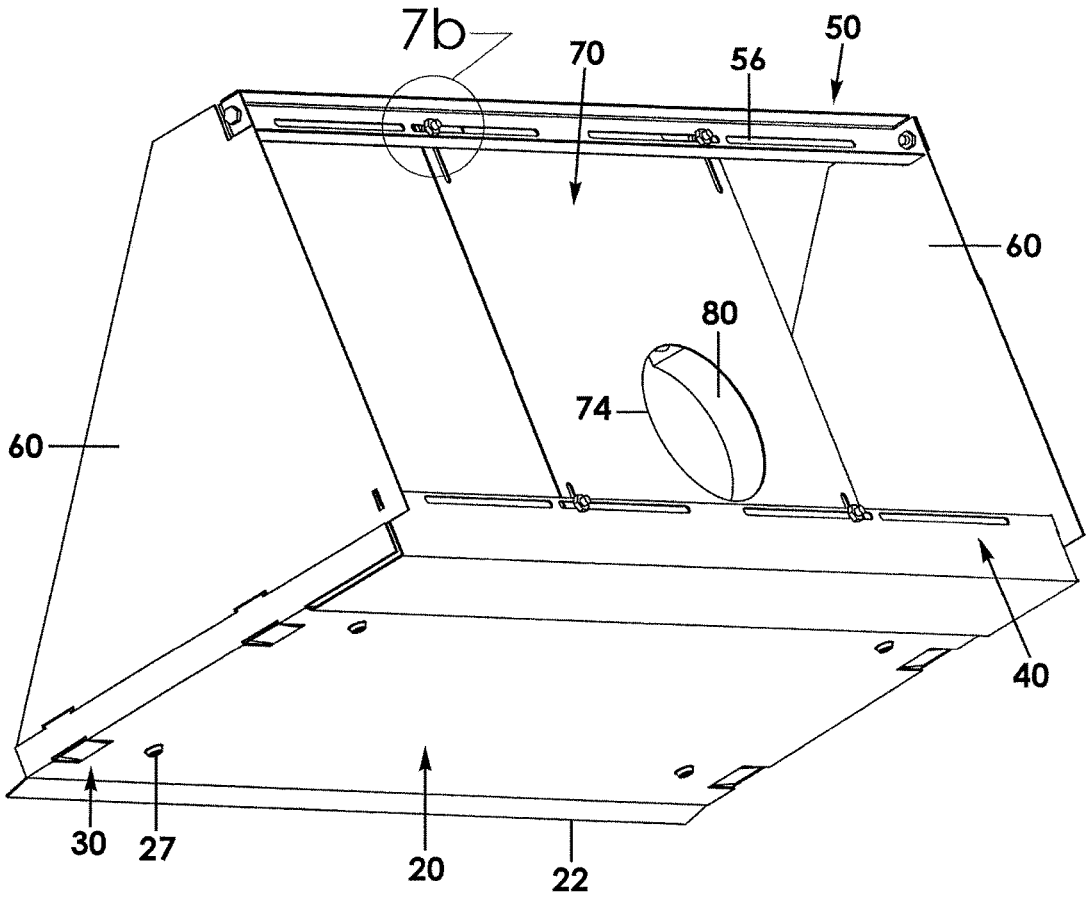
FIG. 6 is a perspective view of the apparatus as in FIG. 1 taken from a reverse and lower angle.

A dryer vent stabilizing apparatus according to a preferred embodiment of the present invention will now be described in detail with reference to FIGS. 1 to 9*b* of the accompanying drawings. The dryer vent stabilizing apparatus 10 includes a base member 20, a first support member 40, and a vent engagement member 70 having a plate portion 72 and a clamp portion 80. The dryer vent stabilizing apparatus 10 is configured for use with a dryer appliance 12 as will be described below.

The base member 20 includes opposed front 22 and rear 24 edges and includes an upper surface 26 and an opposed lower surface. The lower surface has a generally planar configuration such that the base member 20 may be situated on a floor surface. The upper surface 26 also has a generally planar surface that is suitable to support a dryer appliance 12. The base member 20 also includes opposed side edges 28 extending between the front 22 and rear 24 edges. The upper surface 26 of the base member 20 may define a plurality of spaced apart bores 27, each bore 27 having a configuration suitable to receive respective floor fasteners such that the base member 20 may be mounted to a floor surface in use.

The first support member 40 includes a generally elongate linear configuration having opposed first support member ends 42, 44. Preferably, the first support member 40 is operatively coupled to the rear edge 24 of the base member 20. However, as shown in the figures, the base member 20 may include some side wall mounting structures that displace the first support member 40 from the rear edge 24 of the base member 20 as will be described later.

The first support member 40 may define a lateral channel 46 extending substantially between the opposed ends 42, 44 thereof. As shown, the lateral channel 46 of the first support member 40 may be separated into separate segments or may be continuous between the ends. The lateral channel 46 is generally horizontal and linear in configuration.

The vent engagement member 70 may include a plate portion 72 and a clamp portion 80. The plate portion 72 may include a generally planar configuration having a thin construction. The plate portion 72 defines an aperture 74 configured to receive a vent or exhaust duct or tube 14 of a dryer appliance 12 therethrough as will be described in greater detail below. For instance, the aperture 74 may have a generally circular configuration although other configurations would also work.

The vent engagement member 70 may be movably coupled to the first support member 40. In one embodiment, the vent engagement member 70 may be slidably coupled to the lateral channel 46 of the first support member 40 with a fastener 82 and movable therealong between the opposed ends 42, 44. More particularly, the dryer vent engagement member 70 may include a fastener 82 that when extended through the plate portion 72 and into the lateral channel 46 of the first support member 40 enables the plate portion 72 to move slidably along the lateral channel 46 between the opposed ends 42, 44. For instance, the fastener 82 may be a bolt and nut combination configured to extend loosely at first into the lateral channel 46 such that the plate portion 72 may be moved laterally along the lateral channel 46 to a desired position and then the nut may be tightened to secure the plate portion 72 at the desired position.

With specific regard to the plate portion 72, the plate portion 72 may include at least one, but preferably more than one, lateral adjustment channels 76 and may include at least one, but preferably more than one, vertical adjustment channels 78 configured to enable the plate portion 72 to be moved laterally or vertically to accommodate the position of a dryer vent tube coming out of the back of a dryer. It is understood, of course, that a dryer vent tube may exit a dryer appliance from a side or even front and then be routed through the plate portion 72. Alternatively, if the vent tube 14 extends from a side of the dryer, the dryer may slide sideways onto the base member 20. The plate portion 72, therefore, may define a lateral adjustment channel 76 having a generally horizontal configuration. A mounting fastener 82 may be selectively inserted through a lateral adjustment channel 76 into the first support member 40 and the fastener 82 tightened once a desired lateral position has been determined. It is understood that the lateral adjustment channel 76 enables the plate portion 72 to be moved slidably side to side relative to the fastener 82 until tightened and secured.

Similarly, the plate portion 72 may define a vertical/height adjustment channel 78 having a generally vertical configuration, the vertical adjustment channel 78 being generally perpendicular to a respective lateral adjustment channel 76. A mounting fastener 82 may be selectively inserted through a vertical adjustment channel 78 into the first support member 40 and the fastener 82 tightened once a desired vertical position has been determined. It is understood that the vertical adjustment channel 78 enables the plate portion 72 to be moved slidably up and down relative to the fastener 82 until tightened and secured. As shown in the drawings, a lateral adjustment channel 76 and a height adjustment channel 78 may be situated adjacent or even overlapping on one another so as to enable a lateral and height adjustment to be made quickly and easily by a user.

The dryer vent stabilization apparatus 10 includes a pair of side walls 60 coupled to opposite side edges 28 of the base member 20, respectively. Respective side walls 60 extend upwardly from the base member 20 and are generally perpendicular thereto. Opposed ends 42, 44 of the first support member 40 are coupled to lower ends 62 of the side walls 60, respectively, such that the first support member 40 extends substantially between the side walls 60. The side walls 60 are removably coupled to side edges 28 of the base member 20. More particularly, the base member 20 includes latch 30 coupled to a respective side edge 28 that is movable between an extended configuration protruding upwardly from a respective side edge 28 (FIG. 8*a*) and a retracted configuration adjacent a respective side edge 28 (FIG. 8*b*).

Figure 7A:
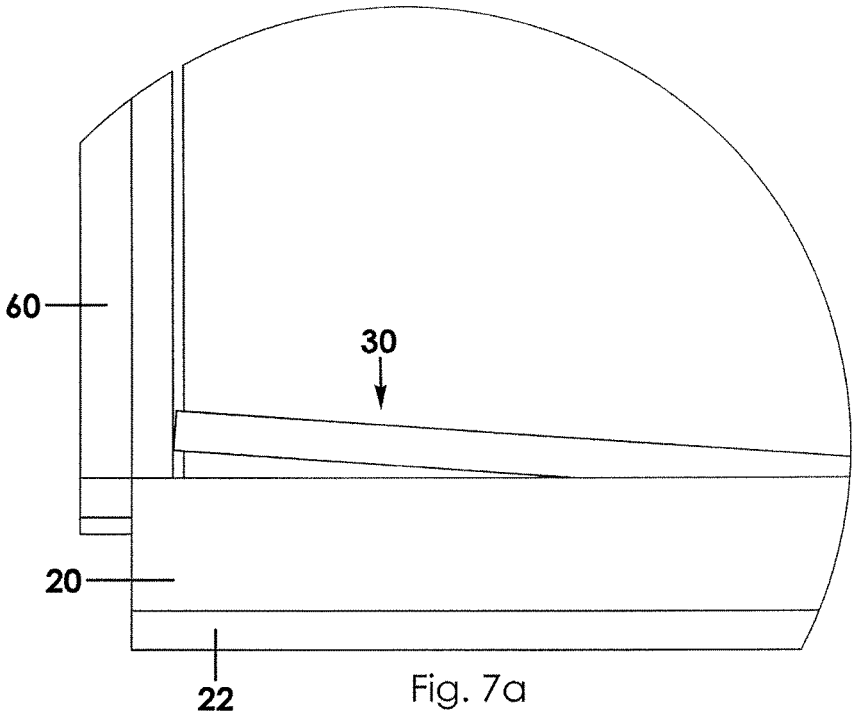
FIG. 7*a* is an isolated view on an enlarged scale taken from FIG. 3*a;*
Figure 7B:
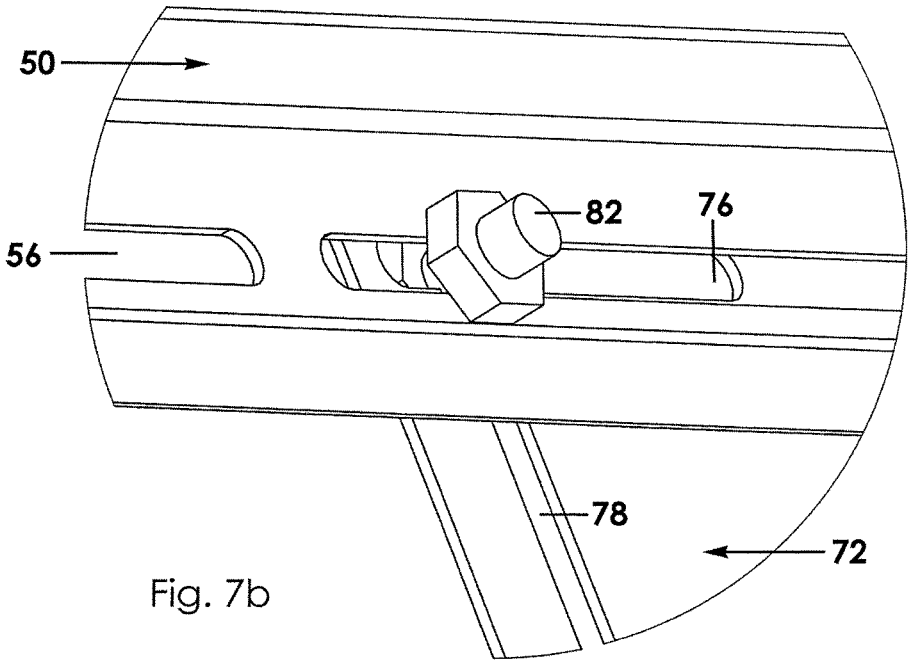
FIG. 7*b* is an isolated view on an enlarged scale taken from FIG. 6.
Figure 8A:
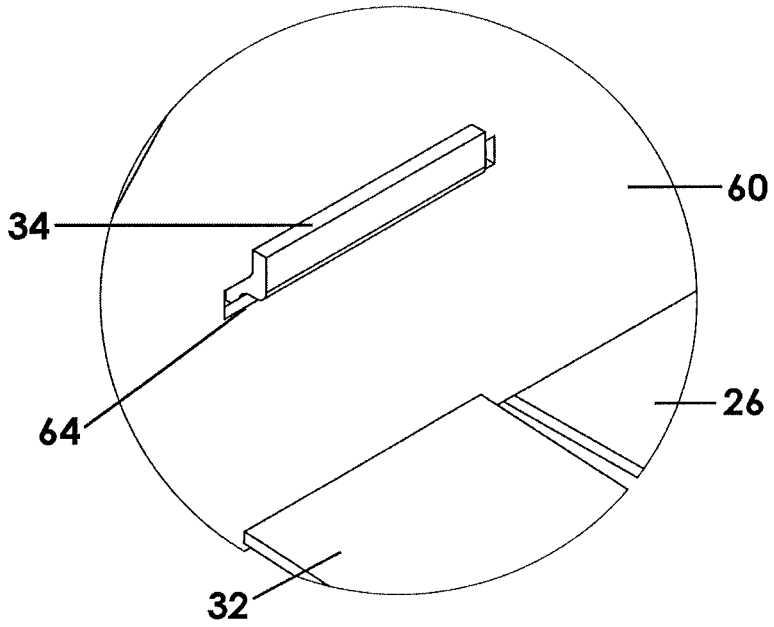
FIG. 8*a* is an isolated view on an enlarged scale taken from FIG. 2.
Figure 8B:
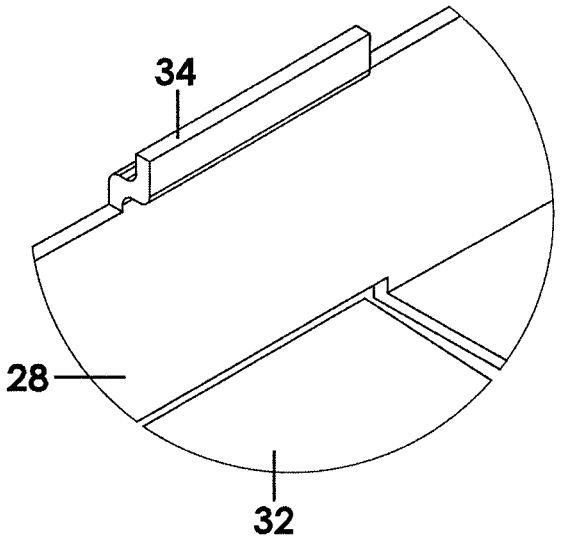
FIG. 8*b* is an isolated view on an enlarged scale taken from FIG. 2.

Each side wall defines a slot 64 adjacent a respective lower end 62, each slot 64 being configured to receive a free end of a latch 30 when at an extended configuration (FIG. 8*a*). Selective movement of the latch 30 between retracted and extended configurations can be seen in FIGS. 7*a*, 8*a*, and 8*b*. Specifically, each latch 30 may include a lower portion 32 situated on the upper surface 26 of the base member 20 adjacent side edges 28 (FIG. 7*a*). The lower portion 32 of the latch 30 is normally displaced from the upper surface 26 of the base member 20. The lower portion 32 is coupled to an upper portion 34 of the latch 30, the upper portion 34 that extends upwardly of a side edge 28 of the base member 20. A user pushing down on the lower portion 32 of a latch 30 causes the upper portion 34 of the latch 30 to be urged downwardly to the retracted latch configuration whereas a release of pressure on the lower latch portion 32 causes the upper portion 34 of the latch 30 to move to the extended latch configuration. It is understood that a latch 30 may include a spring, be constructed of a spring steel material, or the like.

In use, the dryer vent stabilization apparatus 10 may be installed in a home at a position where a dryer appliance 12 is to be installed. It is understood that a dryer appliance 12 should be positioned where there is a dryer vent opening to the outside of the house. In other words, the dryer vent tube 14 that extends from the rear of a dryer appliance 12 (FIG. 9*a*) must be able to be guided outwardly through the dryer vent opening to the outside of the house. Once the dryer vent stabilization apparatus 10 is positioned in this manner, floor fasteners such as bolts or the like may be inserted through the at least one base member bore 27 so as to secure the base member 20 to a floor surface. Then, the dryer appliance 12 may be positioned atop the base member 20.

Figure 9A:
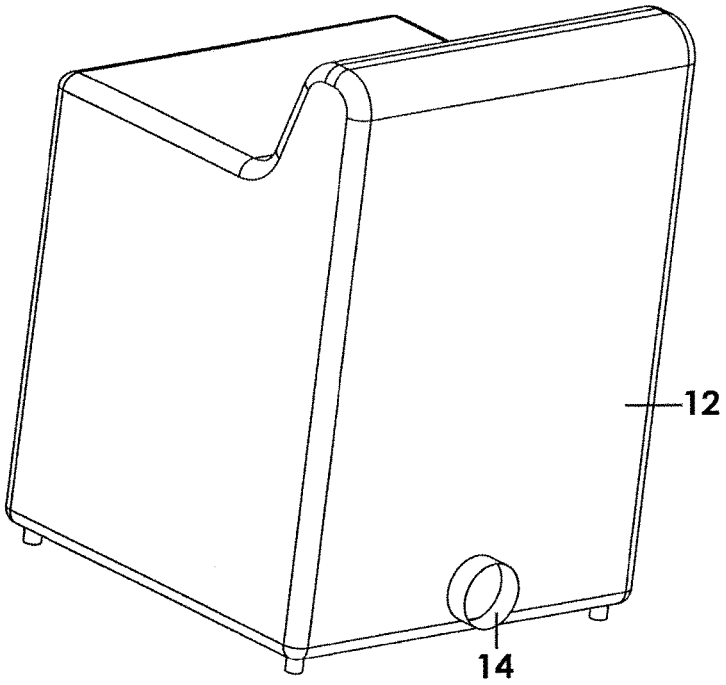
FIG. 9*a* is a rear perspective view of a dryer apparatus.
Figure 9B:
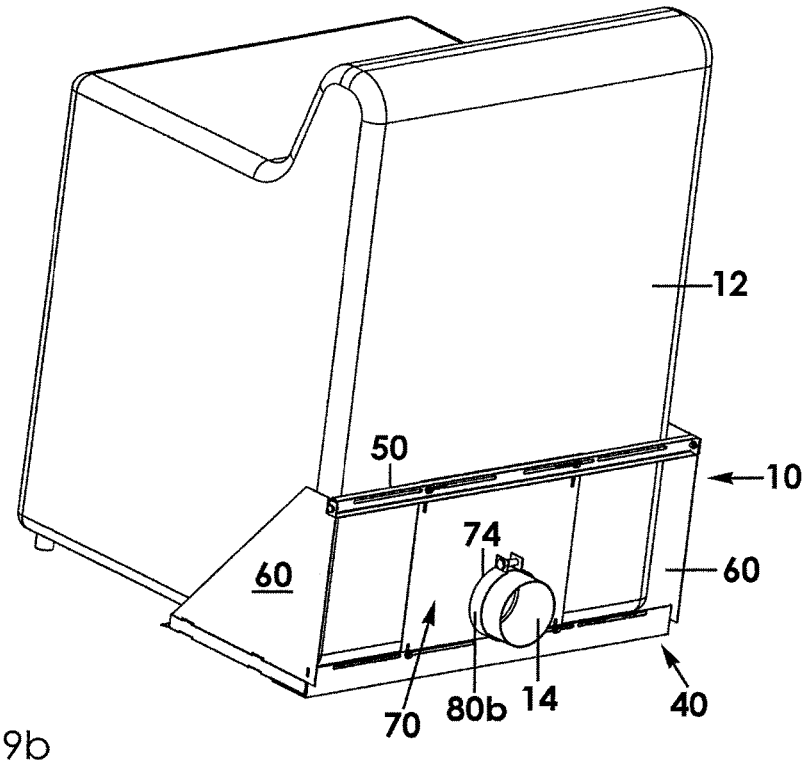
FIG. 9*b* is a rear perspective view of the dryer apparatus in use with dryer vent stabilizing apparatus.

The dryer vent tube 14 may be inserted through the aperture 74 defined by the plate portion 72 of the vent engagement member 70 and clamped securely with the second end 80*b* clamp portion 80 (FIG. 9*b*). It should be appreciated that insertion of the vent tube 14 is made easier in that the clamp portion 80 includes a first end 80*a* having an outwardly tapered configuration sized to receive the dryer vent tube 14—the tapered configuration being illustrated in FIGS. 1 and 2. The vent tube 14 is held securely in the clamp portion 14 with an O-ring type seal 80*c* (FIG. 1). It should be appreciated that the clamp portion 80 provides a "hard duct" extending from the dryer 12 and replaces the flexible tubes currently being used with dryers and which have many disadvantages.

The insertion of the vent duct or tube 14 through the clamp portion 80, however, may prove difficult if the dryer vent tube 14 for the particular dryer appliance is positioned far to the left side of the dryer appliance 12, far to the right side of the dryer appliance 12, or the like. In such case, the plate portion 72 of the vent engagement member 70 may be adjusted laterally and vertically as described above.

Further, the dryer vent stabilization apparatus 10 may include a second support member 50 having opposed second support member ends 52, 54 and defining a lateral channel 56 that extends substantially between the second support member ends 52, 54. In a manner substantially similar to that described above relative to the first support member 40, the vent engagement member 70 may be slidably coupled to the lateral channel 56 and selectively movable therealong between respective second support member ends 52, 54. It is understood lateral adjustment channels 76 and vertical adjustment channels 78 of the plate portion 72 of the vent engagement member 70 may be coupled and adjustable using a respective fastener 82 in a manner as described above. In this manner, the dryer vent tube 14 is stabilized, is not awkwardly twisted so as to inhibit efficient outflow of dryer air, and is protected from later damage.

Also, if the dryer appliance 12 is later desired to be move laterally, this may be accomplished simply by unfastening the floor fasteners, sliding the entire dryer vent stabilization apparatus, and slidably adjusting the plate portion 72 of the vent engagement member 70 laterally so that the vent duct/tube 14 is still properly positioned to exit the house.

It is understood that while certain forms of this invention have been illustrated and described, it is not limited thereto except insofar as such limitations are included in the following claims and allowable functional equivalents thereof.

The invention claimed is:

1. A dryer vent stabilizing apparatus for placement on a support surface and use with a dryer appliance having an appliance bottom, back, and side walls and a vent tube extending from the appliance back, said dryer vent stabilizing apparatus, comprising:

a base member having opposed side edges and opposed front and rear edges extending completely between said side edges, said base member having a planar lower surface bounded by said side, front, and rear edges that is situated in a horizontal plane adjacent the support surface, said base member including an upper surface opposite said lower surface that is configured to receive the appliance bottom and to support the dryer appliance thereon;

a pair of opposed side walls coupled to said opposed side edges of said base member, respectively, said side walls extending upwardly from and generally perpendicular to said upper surface of base member, whereby said base member and said opposed side walls comprise a framework configured to surround the bottom and side walls of the dryer appliance;

a first support member operatively coupled to said rear edge of said base member and extending upwardly and perpendicularly to said upper surface of said base member, said first support member having opposed first support member ends and extending between said pair of opposed side walls and defining a lateral channel extending substantially between respective first support member ends; and a vent engagement member slidably coupled to said lateral channel of said first support member and selectively movable along said lateral channel between said respective first support member ends, said vent engagement member defining an aperture configured to receive the vent tube of the dryer appliance therethrough.

2. The dryer vent stabilizing apparatus as in claim 1, wherein said vent engagement member includes:

a plate portion having a generally planar configuration and extending upwardly from and generally perpendicular to said base member when coupled to said first support member;

wherein said plate portion defines said aperture; and a clamp portion proximate to said aperture and configured to selectively tighten about the vent tube of the dryer apparatus when the vent tube is extended through the aperture.

3. The dryer vent stabilizing apparatus as in claim 2, wherein:

said plate portion of said vent engagement member defines at least one lateral adjustment channel having a generally horizontal orientation; and said vent engagement member includes a fastener selectively extended through said at least one lateral adjustment channel of said vent engagement member and through said lateral channel of said first support member so as to determine a desired lateral position of said vent engagement member.

4. The dryer vent stabilizing apparatus as in claim 3, wherein:

said plate portion of said vent engagement member defines at least one height adjustment channel having a generally vertical orientation and that is perpendicular to said at least one lateral adjustment channel;

said fastener of said vent engagement member is selectively extended through said at least one vertical adjustment channel of said vent engagement member and through said lateral channel of said first support member so as to determine a desired vertical position of said vent engagement member.

5. The dryer vent stabilizing apparatus as in claim 2, wherein:

said plate portion of said vent engagement member defines at least one height adjustment channel having a generally vertical orientation; and said fastener of said vent engagement member is selectively extended through said at least one vertical adjustment channel of said vent engagement member and through said lateral channel of said first support member so as to determine a desired vertical position of said vent engagement member.

6. The dryer vent stabilizing apparatus as in claim 1, wherein said first support member is coupled to and extends between lower ends of said side walls, respectively.

7. The dryer vent stabilizing apparatus as in claim 6, further comprising:

a second support member having opposed second support member ends and defining a lateral channel extending substantially between respective second support member ends; and wherein said vent engagement member is slidably coupled to said lateral channel of said second support member and selectively movable along said lateral channel between said respective second support member ends.

8. The dryer vent stabilizing apparatus as in claim 1, wherein:

said side walls are removably coupled to said base member;

said base member includes a latch operatively coupled to each side edge, respectively, and movable between an extended configuration and a retracted configuration; and each side wall defines a slot configured to selectively receive a respective latch of said base member when said respective latch is at said extended configuration.

9. The dryer vent stabilizing apparatus as in claim 1, wherein said base member defines a plurality of bores configured to receive floor fasteners therethrough, whereby said base member is selectively mounted to a floor surface.

10. A dryer vent stabilizing apparatus for placement on a support surface and for use with a dryer appliance having an appliance bottom, back, and side walls and a vent tube extending from the appliance back, said dryer vent stabilizing apparatus, comprising a base member having opposed side edges and opposed front and rear edges extending completely between said side edges, said base member having a planar lower surface bounded by said side, front, and rear edges that is situated in a horizontal plane adjacent the support surface, said base member including an upper surface opposite said lower surface that is configured to receive the appliance bottom and to support the dryer appliance thereon;

a pair of opposed side walls coupled to said opposed side edges of said base member, respectively, said side walls extending upwardly from and generally perpendicular to said upper surface of base member, whereby said base member and said opposed side walls comprise a framework configured to surround the bottom, back, and side walls of the dryer appliance;

a first support member operatively coupled to said rear edge of said base member and extending upwardly and perpendicularly to said upper surface of said base member, said first support member having opposed first support member ends and extending between said pair of opposed side walls and defining a lateral channel extending substantially between respective first support member ends;

a vent engagement member movably coupled to said first support member, said vent engagement member including a plate portion having a generally planar configuration that is generally perpendicular to said base member when coupled to said first support member;

wherein:

said plate portion defines an aperture configured to receive the vent tube therethrough;

said plate portion of said vent engagement member defines at least one lateral adjustment channel having a generally horizontal orientation; and said vent engagement member includes a fastener selectively extended through said at least one lateral adjustment channel of said vent engagement member and coupled to said first support member so as to determine a desired lateral position of said vent engagement member.

11. The dryer vent stabilizing apparatus as in claim 10, wherein:

said plate portion of said vent engagement member defines at least one height adjustment channel having a generally vertical orientation; and said fastener of said vent engagement member is selectively extended through said at least one vertical adjustment channel of said vent engagement member and is coupled to said first support member so as to determine a desired vertical position of said vent engagement member.

12. The dryer vent stabilizing apparatus as in claim 10, wherein:

said plate portion of said vent engagement member defines at least one height adjustment channel having a generally vertical orientation and that is perpendicular to said at least one lateral adjustment channel; and said fastener of said vent engagement member is selectively extended through said at least one vertical adjustment channel of said vent engagement member and and is coupled to said first support member so as to determine a desired vertical position of said vent engagement member.

13. The dryer vent stabilizing apparatus as in claim 10, wherein said vent engagement member includes a clamp portion proximate to said aperture and configured to selectively tighten about the vent tube of the dryer apparatus when the vent tube is extended through the aperture.

14. The dryer vent stabilizing apparatus as in claim 10, wherein said first support member is coupled to and extends between lower ends of said side walls, respectively.

15. The dryer vent stabilizing apparatus as in claim 10, further comprising:

a second support member having opposed second support member ends and defining a lateral channel extending substantially between respective second support member ends; and wherein said vent engagement member is slidably coupled to said lateral channel of said second support member and selectively movable along said lateral channel between said respective second support member ends.

16. The dryer vent stabilizing apparatus as in claim 10, wherein:

said side walls are removably coupled to said base member;

said base member includes a latch operatively coupled to each side edge, respectively, and movable between an extended configuration and a retracted configuration; and each side wall defines a slot configured to selectively receive a respective latch of said base member when said respective latch is at said extended configuration.

17. The dryer vent stabilizing apparatus as in claim 10, wherein said base member defines a plurality of bores configured to receive floor fasteners therethrough, whereby said base member is selectively mounted to a floor surface.

* * * * *